US005979747A

United States Patent [19]

Gnadt et al.

[11] Patent Number: 5,979,747

[45] Date of Patent: Nov. 9, 1999

[54] CARRIER FOR PACKAGES

[75] Inventors: David Gnadt, Owings Mills; Gregory Alan Lathrop, Manchester, both of Md.

[73] Assignee: Lever Brothers Company, New York, N.Y.

[21] Appl. No.: 08/882,659

[22] Filed: Jun. 25, 1997

Related U.S. Application Data

[63] Continuation of application No. 08/350,875, Dec. 7, 1994, abandoned.

[51] Int. Cl.[6] ..... B65D 5/4805; B65D 5/462

[52] U.S. Cl. ..... 229/120.17; 229/117.14; 229/164; 229/904

[58] Field of Search ..... 229/117.14, 120.09, 229/130.17, 164, 904; 206/167, 168, 193, 194, 196–199, 427, 435

[56] References Cited

U.S. PATENT DOCUMENTS

| | | | |
|---|---|---|---|
| D. 110,691 | 8/1938 | Dudley | 206/199 |
| 2,111,621 | 3/1938 | Gerking et al. | 206/198 |
| 2,296,937 | 9/1942 | Lyons, Jr | 206/168 |
| 2,298,191 | 10/1942 | Boh | 206/168 |
| 2,331,312 | 10/1943 | Dorfman | 206/168 |
| 2,336,857 | 12/1943 | Gies et al. | 206/198 |
| 2,445,202 | 7/1948 | Belanger | 206/198 |
| 2,575,654 | 11/1951 | Casler | 229/117.14 |
| 2,721,001 | 10/1955 | Hasselhoff | 229/120.17 |
| 2,850,223 | 9/1958 | Strauss | 229/120.17 |
| 2,906,431 | 4/1959 | Kates | 229/117.14 |
| 2,934,252 | 4/1960 | Wickstrom | 229/120.17 |
| 3,474,949 | 10/1969 | Shine | 229/120.09 |
| 4,119,202 | 10/1978 | Roth | 229/164 |
| 4,286,709 | 9/1981 | Manizza | 229/117.14 |

FOREIGN PATENT DOCUMENTS

| | | | |
|---|---|---|---|
| 1559737 | 2/1969 | France | 206/196 |

OTHER PUBLICATIONS (3) Photographs of prior art Purex carrier.

*Primary Examiner*—Gary E. Elkins
*Attorney, Agent, or Firm*—Gerard J. McGowan, Jr.

[57] ABSTRACT

A carrier for multiple packages. The carrier is particularly suitable for packages containing household products such as detergent bottles or cartons. The carrier includes dividing walls which in two embodiments are hinged together at the top. The dividing walls may also be hinged together at the sides. The carrier provides side walls and a bottom to hold the package in place. The carrier does not require shrink wrap.

11 Claims, 7 Drawing Sheets

CARRIER FOR PACKAGES

This is a continuation application of Ser. No. 08/350,875, filed Dec. 7, 1994, abandoned.

BACKGROUND OF THE INVENTION

Recent years have seen the evolution of household products, particularly laundry products into new and varied forms. The use of liquid laundry detergents, which provide consumers with the opportunity to pretreat selected areas of the clothes with the detergent prior to washing, is more prevalent now than in years past. On the powders side of the business, increases in concentration, and therefore weight, have been undertaken to minimize packaging. In addition, many consumers looking for value purchase larger quantities of product at a single time. These larger quantities may be reflected in packages containing higher effective doses of product and/or in greater number of items purchased at the same time.

There is on the market a carrier for bottles of household products sold under the "Purex" brand. The Purex carrier comprises two dividing walls hinged at the top, each of which has a bottom flap separated from the dividing wall by a fold line. The Purex carrier also includes sidewalls on either side of each dividing panel and separated therefrom by fold lines. The Purex carrier includes shrink wrap to keep bottles contained and supported within the carrier. Without the shrink wrap, the bottles would fall through the carrier. The Purex carrier also includes a handle.

It will be appreciated that the purchase of heavier and/or multiple items will increase the burden on the consumer carrying home goods from the supermarket. Tearing of paper or plastic grocery bags stuffed with heavy items, including detergent and other household products, is not uncommon. There is a need therefore for a carrier suitable for transporting by hand larger and multiple packages, especially packages of household products such as detergent cartons and bottles.

SUMMARY OF THE INVENTION

The present invention is directed to carriers for multiple packages such as detergent cartons and bottles. In a first embodiment, the invention comprises a carrier having two dividing walls, side panels and a base flap, which define multiple package receiving areas. Package restraining means extend into the package receiving areas to minimize the movement of the packages within the package receiving areas and to prevent the packages from exiting the areas. In a preferred embodiment, the package restraining means extend from the first and second dividing walls and each comprise a flap attached to the dividing walls by a scoreline which forms hinge. The flaps may include an aperture for receiving the package, e.g., a circular aperture for receiving the neck or finish of a bottle. The bottoms of the package receiving areas may be formed from base flaps extending from the dividing walls and from additional flaps extending from the side walls. The bottom forming flaps are preferably glued together.

In a preferred embodiment, the dividing walls are hinged to each other, preferably at the top, which hinge is formed by a perforated scoreline. Advantageously, a handle is formed elongated apertures in the dividing walls.

The sidewalls and the bottom flaps must be suitable to support the weight of each package which the carrier is to contain. However, it may be desirable to cut away a portion of the sidewall to enhance viewing of the product from the side. A minimum amount of side wall must be retained to provide sufficient strength to hold the product adequately. It has been found that the angle formed by the sidewall with the bottom panel should be at least 30°, preferably at least 45° and most preferably at least 60°.

An advantage of the use of dividing walls which are hinged at the top is that where the carrier is bumped or otherwise disturbed the package receiving areas may move independently, thereby minimizing the likelihood that one of the packages will tear away from the carrier.

A second embodiment is provided which is particularly adapted to containing detergent cartons. The second embodiment is similar to the first except that it does not need to include the package restraining means cut from the dividing walls and in that it further includes a front panel. which is separated from the base flap by a fold line. The front panel additionally includes front panel side flaps which adhere to the sidewalls of the carrier. With the front panel in place, the carrier is well adapted to transport cartons, but also bottles as well.

In accordance with still a third embodiment of the invention, a carrier is provided which is also suitable for either cartons or bottles. In this case, the carrier includes dividing walls which are preferably hinged on one side edge thereof rather than at the top. The two dividing walls of the carrier of the third embodiment are preferably additionally held together by mechanical locking means. For instance, the locking means may comprise a piece of cardboard cut partially from a first one of the dividing walls, but left attached to the dividing wall on at least one side, and an aperture cut in the second dividing wall into which the first piece of material may be placed. Preferably the aperture is smaller than the material cut from the first dividing wall so that the material can retain the dividing wall in position. In a preferred embodiment the partial cut in the first wall comprises a semi-circle and the aperture in the second wall is generally in the shape of a square, which is smaller than, and fits within the border of, the semi-circle.

The present invention is also directed to carton blanks for forming the carriers of the invention.

Another aspect of the invention is a handle formed from one or more flaps in a wall, which is/are folded upwardly. An aperture in the upwardly folded flap forms the handle.

Still another aspect of the invention is a mechanical locking means to lock two walls or panels together. The means comprises an aperture in one wall and a flap formed by partial cuts in the other. The flap is larger than the aperture and is pushed through the aperture to lock the walls together.

For a more complete understanding of the above and other features and advantages of the invention, reference should be made to the following detailed description of preferred embodiments and to the accompanying drawings.

DETAILED DESCRIPTION OF THE INVENTION

Figure 1:
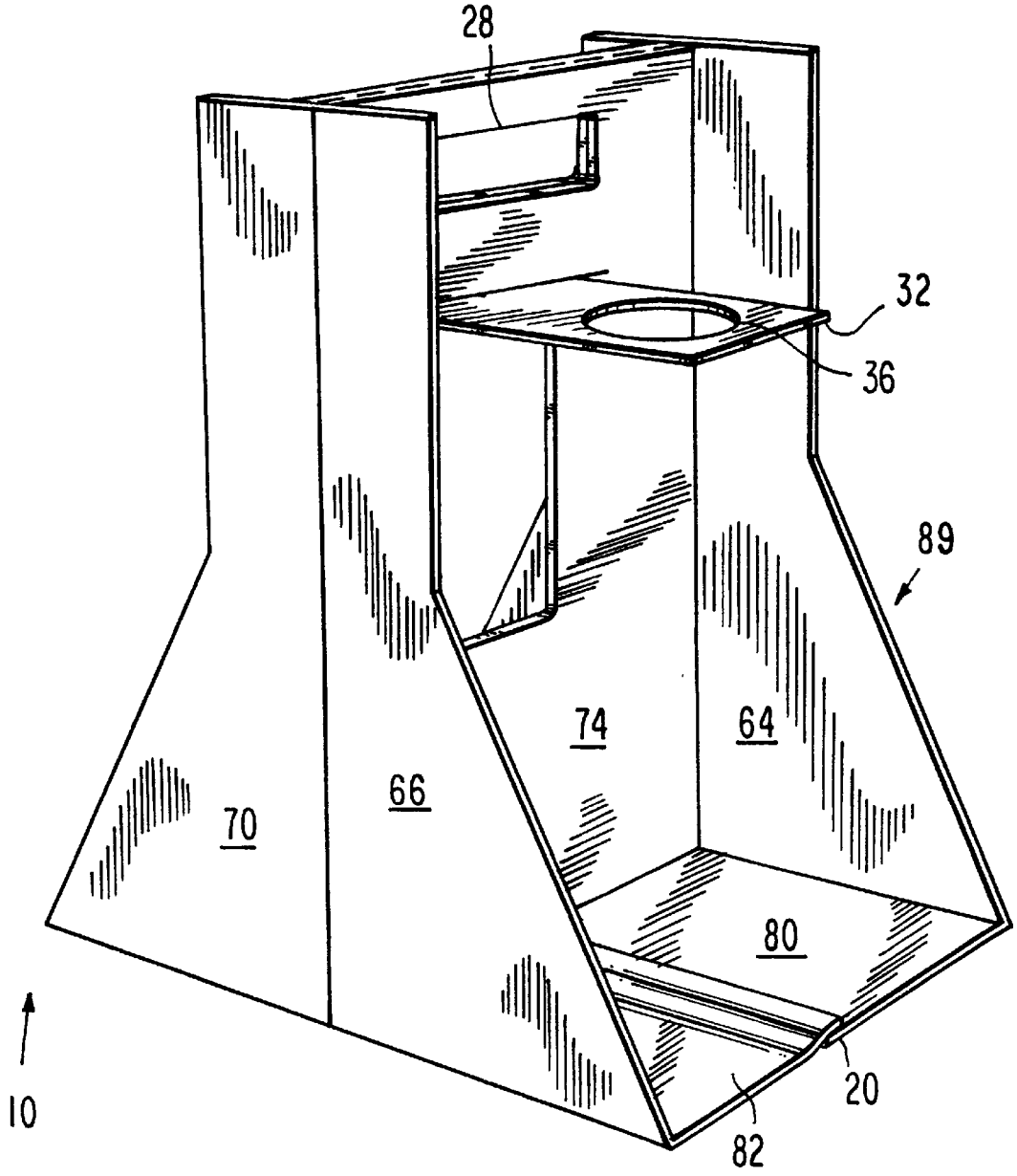
FIG. 1 is a perspective view of a carrier according to the first embodiment of the invention.
Figure 2:
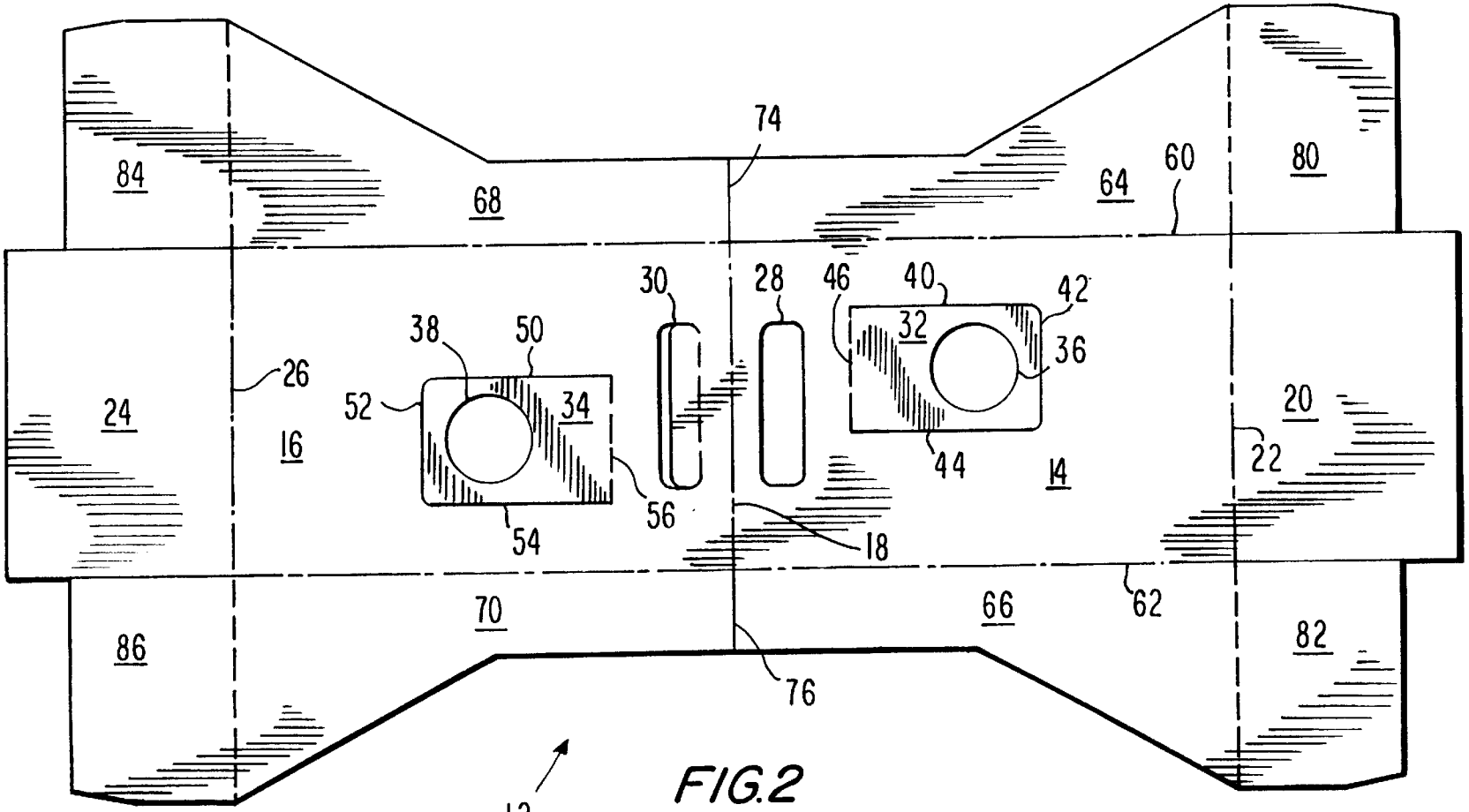
FIG. 2 is top plan view of a blank for producing the carrier according to the first embodiment.

As seen in FIGS. 1 and 2, carrier 10 is formed from blank 12, which is made of corrugated board. Blank 12 comprises first dividing panel 14, separated from second dividing panel 16 by transverse perforated cut scoreline 18. On the side of dividing panel 14 opposite that of dividing panel 16 is first base section flap 20, which is separated from dividing panel 14 by transverse scoreline 22. Likewise, a second base section flap, 24 is separated from second dividing panel 16 by transverse scoreline 26. Handle-forming apertures 28 and 30 are present in first and second dividing panels 14 and 16, respectively.

Base section flaps 20 and 24 in FIG. 2 each have a free edge on a side opposite the dividing panel to which it is attached.

Flaps 32 and 34 are provided in dividing panels 14 and 16, respectively. Flaps 32 and 34 include apertures 36 and 38, which are generally circular. Generally rectangular flap 32 is formed in the shape of a rectangle by full cut lines 40, 42, and 44 and by fold line 46. Generally rectangular flap 34 is formed from full cut lines 50, 52, and 54 and by fold line 56. As illustrated, flaps 32 and 34 are offset in opposite directions from the center longitudinal axis of the blank, but they may be positioned elsewhere as desired to accomodate the packages for which the carrier is to be used.

Separated from dividing panel 14 by scorelines 60 and 62, respectively, are side panels 64 and 66. Likewise, separated from dividing panel 16 by scorelines 60 and 62 are side panels 68 and 70. Full cut line 74 separates side panel 64 and 68 whereas full cut line 76 separates side panels 66 and 70.

Side panels 64 and 66 are separated by scoreline 22 from flaps 80 and 82 while flaps 84 and 86 are separated from side panels 68 and 70 by transverse scoreline 26.

Carrier 10 is formed by folding blank 12 along perforated scoreline 18 which serves as a fold line. Then, side panels 64, 66, 68 and 70 are folded perpendicularly to their respective dividing panels. Flaps 80, 82, 84 and 86 are folded perpendicularly to side panels 64, 66, 68 and 70, after which base section flaps 20 and 24 are folded perpendicularly to dividing panels 14 and 16 and adhered to the undersides of flaps 80, 82, 86 and 84.

When it is desired to use the carrier, restraining means flap 32 is folded outwardly and perpendicularly to dividing panel 14. The cap is inserted thorugh aperture 36 so that the neck of the bottle is received within the aperture. Thus, the bottle is restrained within package receiving area 89 formed from dividing panel 14, side panels 64 and 66 and bottom flaps 80, 82 and 20. A bottle may be similarly be placed in the second receiving area, defined by dividing panel 16, side panels 70 and 68 and bottom flaps 84, 24, and 86.

Restraining means (or restrainer) 32 and 34 keep the bottles within the respective receiving areas. In the event that the carrier is bumped while it is being carried, either of the receiving areas is free to swing independently of the other, which may minimize the likelihood that one bottle will tear away from the carrier. The carrier does not require shrink wrap or other films or paper to secure the bottle to the package receiving area. The angle that the side walls make to the bottom of the carrier helps provide the carrier with sufficient strength to contain heavy bottles such as bottles of up to 17 pounds particularly uup to 20 pounds and even up to 25 pounds or more.

It is a particular advantage that the carriers of the invention can bemade from a single carton blank and are self-supporting of the packages without addition of shrink wrap or other materials (other than adhesives) extraneous to the blank.

The blank is preferably made of E-Flute or other corrugated board such as B-. or C-Flute. The weight of the cartons or bottles or other packages on both sides of the dividing panels serves to balance and to stabilize the carrier.

The carrier of the invention is strong and durable. While it is illustrated as including one package restraining means per package receiving area, it will be apparent that more than one package restraining means per package receiving area may be present.

Figure 3:
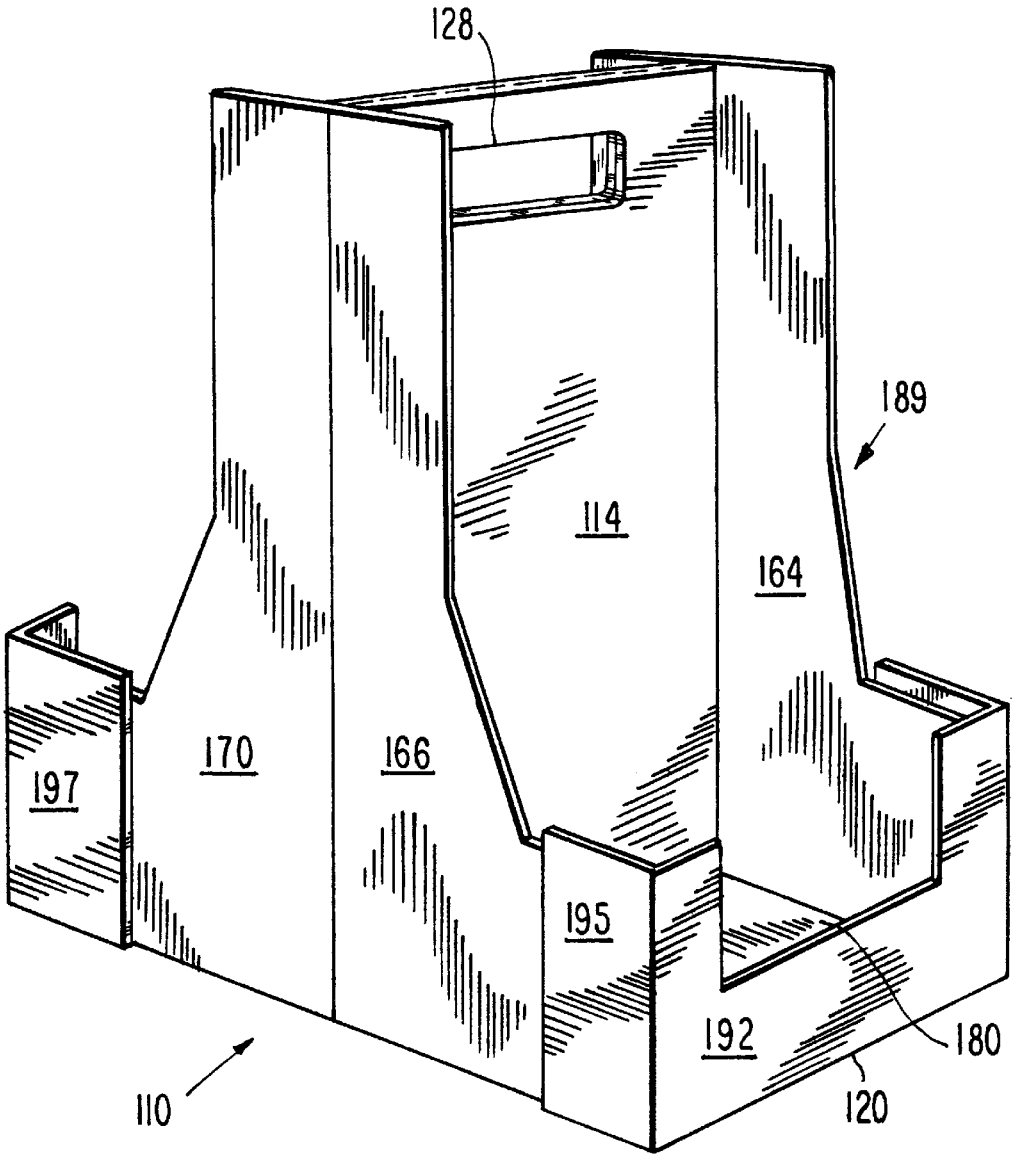
FIG. 3 is a perspective view of a carrier according to a second embodiment of the invention.
Figure 4:
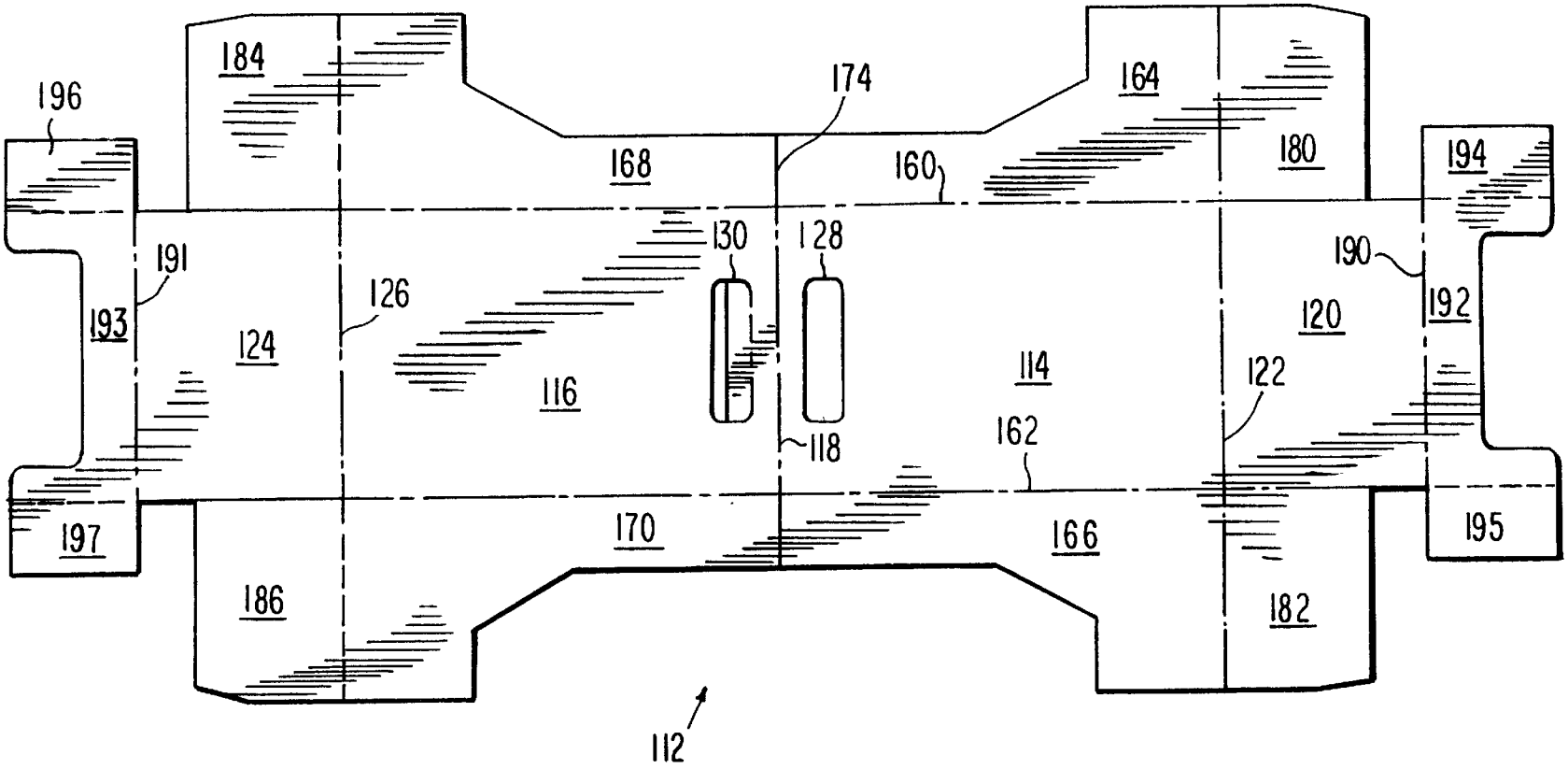
FIG. 4 is a top plan view of a blank for producing a carrier according to the second embodiment of the invention.

A second embodiment of the invention can be seen in FIGS. 3 and 4. Blank 112 includes central panels 114 and 116 separated by scorelines 122 and 126 from base section flaps 120 and 124. Scoreline 122 separates side panels 164 and 166 from flaps 180 and 182. Scoreline 126 separates side panels 168 and 170 from flaps 184 and 186. Handle apertures 128 and 130 are formed in first and second dividing panels 114 and 116.

Separated from base section flaps 120 and 124 by fold lines 190 and 191 respectively are front panels 192 and 193. Separated from front panel 192 on either end thereof by fold lines 160 and 162 are side flaps 194 and 195. Separated from front panel 193 by scorelines 160 and 162 are side flaps 196 and 197 at either end thereof.

When it is desired to use this second embodiment, dividing panels 114 and 116 are folded along perforated scoreline 118. Then, side panels 164 and 166, 168 and 170 are folded perpendicularly to the respective dividing panels. Flaps 1 80,182,184 and 186 are folded perpendicularly to their respective side panels and flaps 120 and 124 are folded perpendicularly to dividing panels 114 and 116. Front panels 192 and 193 are then folded perpendicularly base section flaps 120 and 124 and side flaps 194,195.196 and 197 are folded perpendicularly to front panels 192 and 193 and adhered to side flaps 164,166,184 and 186 with hot melt or other adhesive.

As seen in FIG. 3, package receiving space 189 is formed from dividing panel 114, side panels 166 and 164 and bottom flaps 180, 182 and 120. Receiving space 189 forms a pocket within which a carton or bottle may be received and stably accommodated. As with the previous embodiment, the weight of the cartons or bottles or other packages on both sides of the dividing panels serves to balance and to stabilize the carrier. In the event that the carrier 110 experiences a bump or other disturbance while being transported by hand, it is not necessary that both receiving spaces react as they are separated and can swing independently. The blank and carrier are preferably made of corrugated board.

Figure 5:
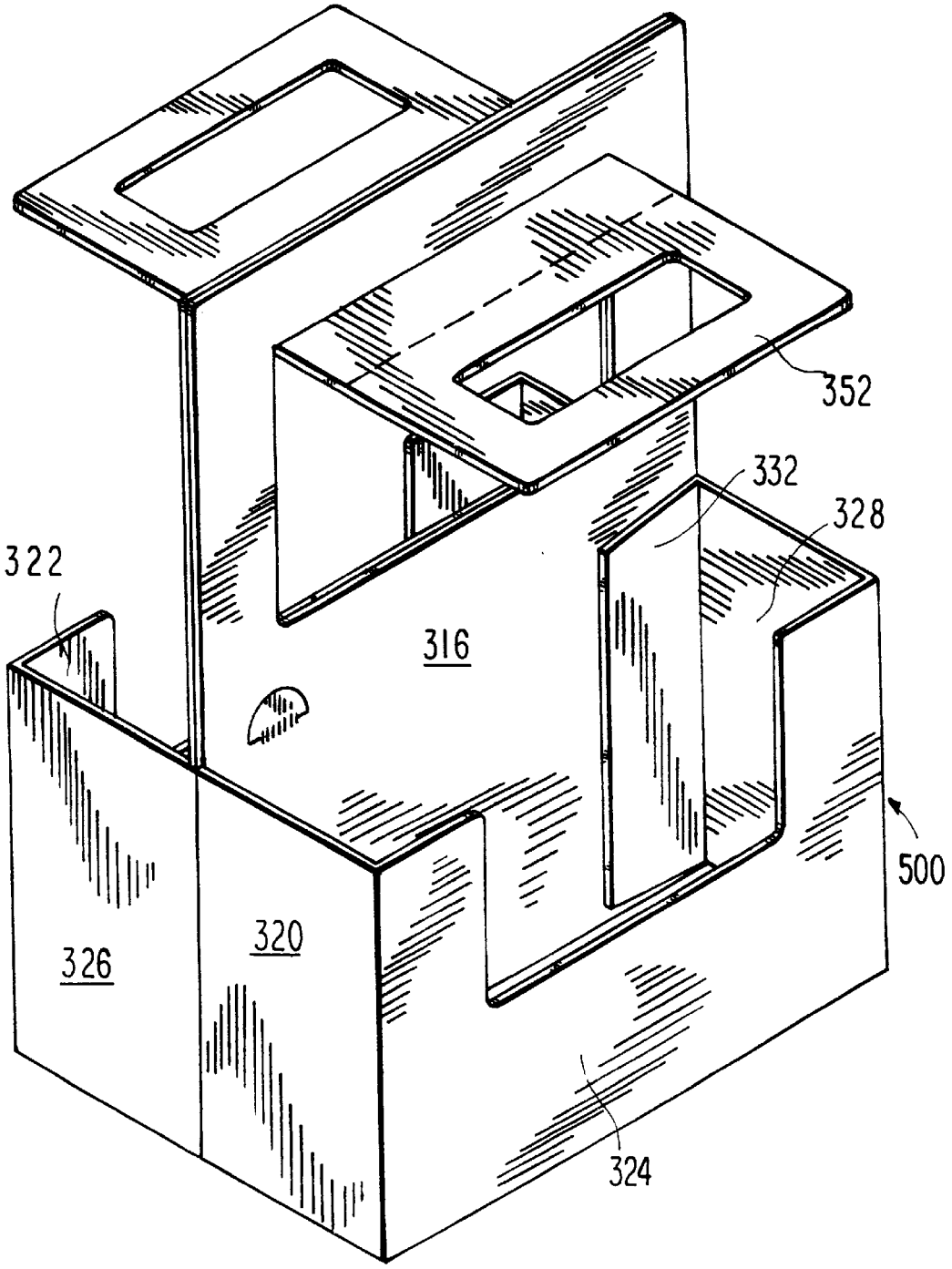
FIG. 5 is a perspective view of a carrier according to a third embodiment of the invention.
Figure 6:
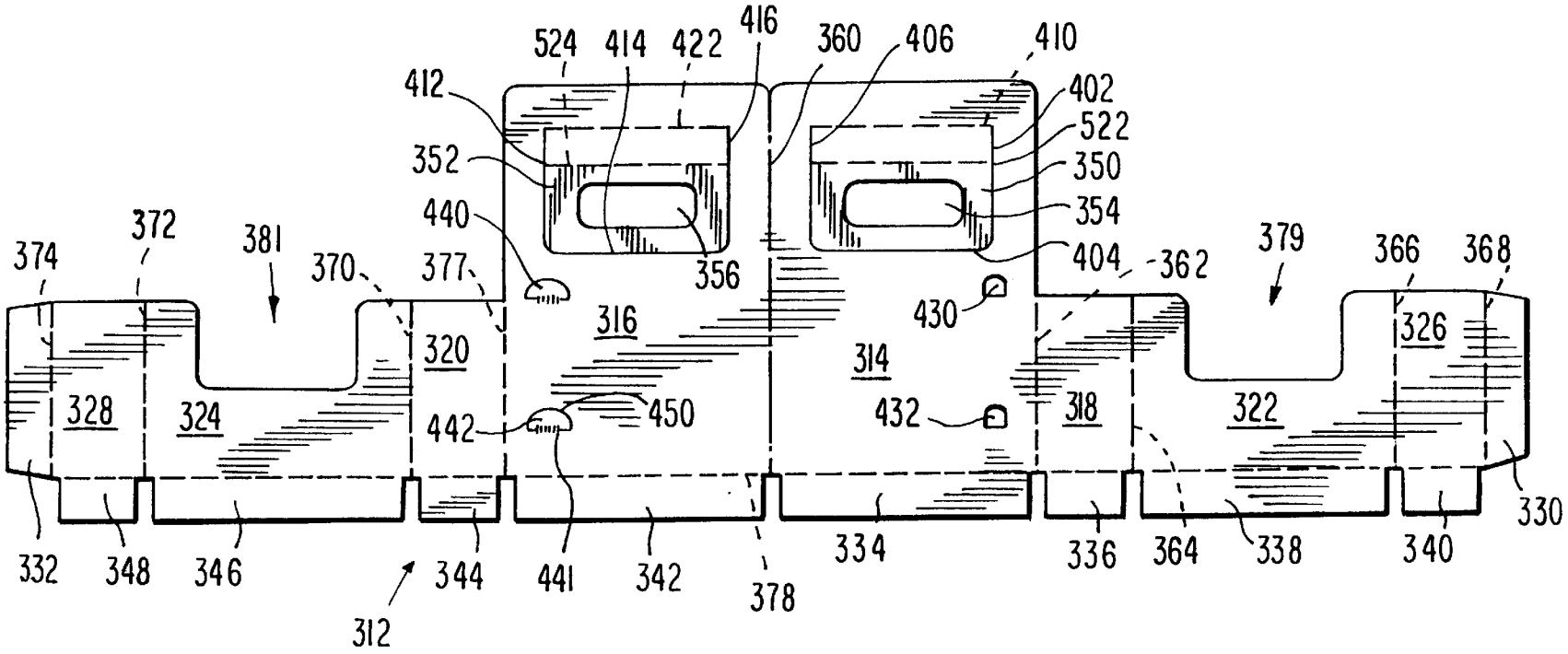
FIG. 6 is a top plan view of a blank useful for forming a carrier in accordance with the third embodiment of the invention.
Figure 7:
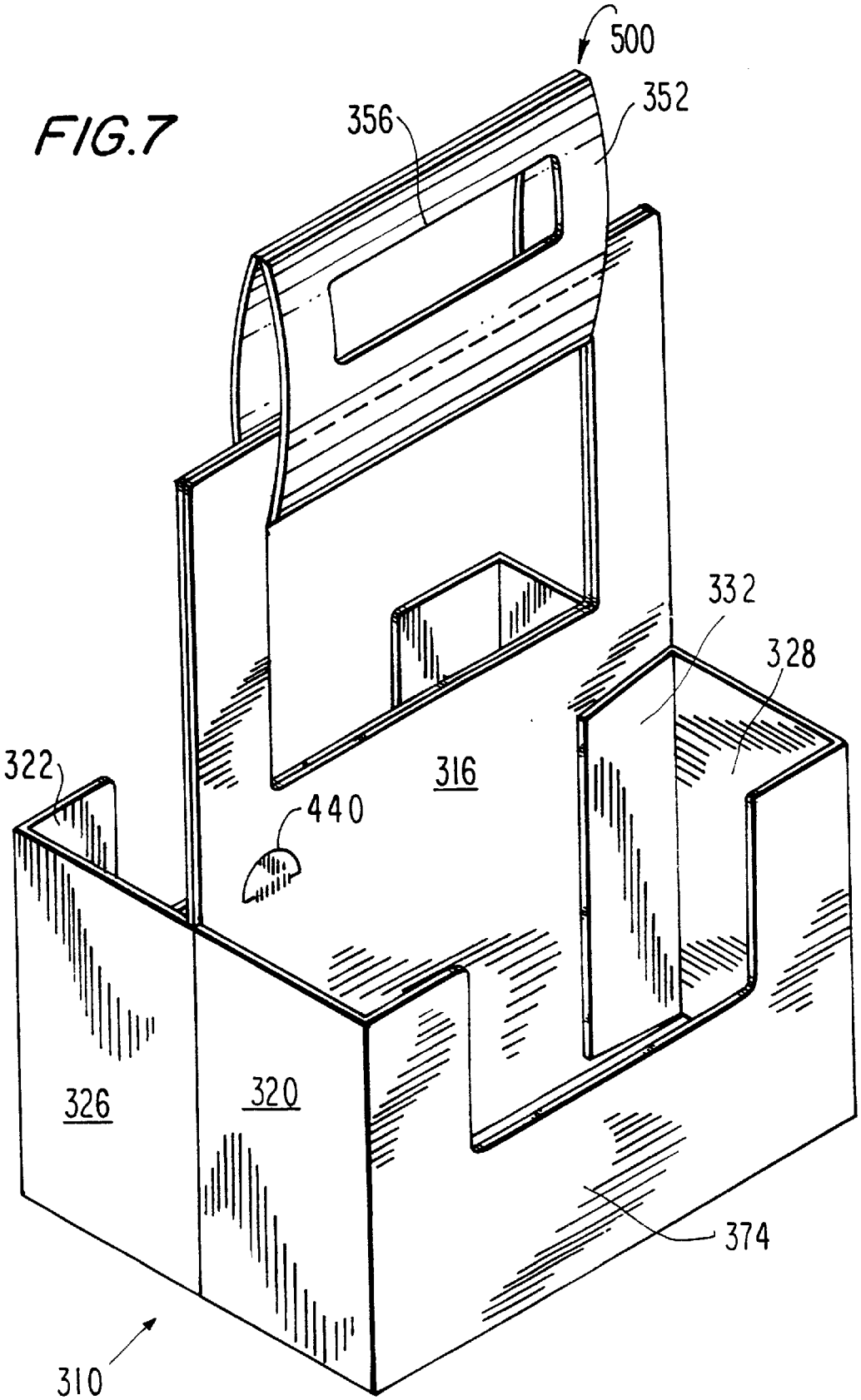
FIG. 7 is a perspective view similar to that of FIG. 5, except that the handle is formed in the carrier.

A carrier according to the third embodiment of the invention is seen in FIGS. 5 and 7 and the blank from which it is made is seen in FIG. 6. Blank 312 comprises first dividing wall 314 and second dividing wall 316 separated from wall 314 by perforated scoreline 360. Separated from dividing wall 314 by fold line 362 is first side panel 318. First front panel 322 is separated from first side panel 318 by transverse scoreline 364 and third side panel 326 is separated first front panel 322 by transverse scoreline 366. First glue flap 330 is separated from third side panel 326 by transverse scoreline 368.

Second side panel 320 is separated from second dividing wall 31 6 by transverse fold line 377. Second front panel 324 is separated from second side panel 320 by transverse fold line 370 and fourth side panel 328 is separated from second front panel 324 by transverse fold line 372. Second glue flap 332 is separated from fourth side panel 328 by transverse scoreline 374.

First and second front panels 322 and 324 include openings 379 and 381 cut therein to permit ready viewing of the packages contained within the carriers.

Panels 328, 324, 320, 316, 314, 318, 322 and 326 are separated by scoreline 378 from bottom flaps 348, 346, 344, 342, 334, 336, 338 and 340.

First dividing wall 314 includes flap 350 which is defined by cut lines 402, 404, and 406. Flap 350 remains attached to dividing wall 314 by fold line 410.

Likewise, flap 352 is cut from second dividing wall 316 by cut lines 412, 414 and 416. It remains attached to wall 316 and hinged thereto by fold line 422.

Cut within flaps 350 and 352, respectively, are apertures 354 and 356 which will form the handle of the invention as described herein below.

Fold lines 522, 524 permit the handle to fold if it is desired to stack the carriers having fully formed handles shown in FIG. 7 one on top of the other.

First dividing wall 314 includes two square-shaped apertures 430 and 432 on the side opposite the hinge 306. Second dividing wall 316 includes two semicircular flaps defined by C-shaped cuts. The flaps are 440 and 442 and are disposed at the side of dividing wall 316 opposite the side having hinge 360. Flap 442 can be seen to be defined by C-shape cut 450 and fold line 441 which keeps the remainder of flap 442 attached to second dividing wall 316. Flap 440 is similar.

Carrier 310 is formed by folding dividing wall 314 and 316 along the hinge defined by the perforated scoreline 360. First side panel 318 is folded perpendicularly to first dividing wall 314, then first front panel 322 is folded perpendicularly to first side panel 318, after which third side panel 326 is folded perpendicularly to front panel 322 and first glue flap 330 is folded and adhered to first dividing wall 314. The glue flap may be adhered with hot melt or other suitable adhesive. Panel 320, 324 and 328 are likewise folded and glue flap 332 likewise folded and adhered to panel 316. Bottom flaps 334, 336, 338, 340, 342, 344, 346 and 348 are all folded and adhered to each other so as to form a bottom for the carrier. Flaps 440 and 442 are then pushed through square apertures 430 and 432 respectively to lock the dividing panels together. Flaps 350 and 352 are pulled upwardly and adhered together to form handle apertures 356, 354, and, thereby, handle 500.

Packages such as detergent cartons can be placed in package receiving space 520 defined by dividing wall 316, side panels, 320, 328, and front panel 324 and the bottom flaps 348, 346, 344 and 342. Likewise, a second carton or bottle may be place in the second bottle receiving space on the opposite side of the carrier.

It will be appreciated that in all of the embodiments more than one package may be kept in each product space e.g., 1, 2, 4 or 6 on each side of the carrier. Also, multiple product spaces on each side of the carrier may be formed as appropriate. The carrier may contain mixed packages, e.g. cartons and bottles. Preferably, the weight of the packages in each aide of the carrier is substantially the same. The carrier of the invention does not in any of its embodiments require shrink wrap or other films or paper to secure the bottle to the package receiving area. It is an advantage of the invention that such additional materials are not required, and preferably are not used, although they may be employed if desired. It is also an advantage that the carriers may be made from a single integral blank and can support procuts of up to 17 pounds, especially up to 20 pounds, even up to 25 pounds and above without the addition of shrink wrap or other materials extraneous to the blank other than adhesive. E.g., it is expected that packages ranging from one pound to above 50 pounds each may be accomodated.

Where the term scorelline is used herein, it will be undeerstood that other fold lines may be used.

It should be understood, of course, that the specific forms of the invention herein illustrated and described are intended to be representative only, as certain changes may be made therein without departing from the clear teaching of the disclosure. Accordingly, reference should be made to the following appended claims in determining the full scope.

What is claimed is:

1. A carrier for multiple packages comprising a) a first dividing wall having a top and a bottom, b) a second dividing wall having a top and a bottom, c) said first and second dividing walls being hinged to each other at a hinge at their tops, d) a first base flap separated from said first dividing wall by a fold line at said first dividing wall bottom, e) a second base flap separated from said second dividing wall by a fold line at said second dividing wall bottom, f) a first side panel separated from said first dividing wall by a fold line adjacent to said hinge, g) a second side panel separated from said second dividing wall by a fold line adjacent to said hinge, h) said first dividing wall, first side panel, and first base flap defining a first package receiving area, i) said second dividing wall, second side panel, and second base flap defining a second package receiving area, j) first and second package restraining flaps extending respectively from said first and second dividing walls into said first and second package receiving areas, each of said first and second side panels including flaps separated therefrom by a fold line adjacent said fold line separating said first or second side panel from said first or second dividing wall, said side panel flaps forming with said first or second base flap a bottom for said carrier, each of said first and second dividing walls further including an auxiliary side panel and each auxiliary side panel including an auxiliary side panel flap separated by an auxiliary side panel flap-separating fold line adjacent a fold line separating said auxiliary side panel from said first or second dividing wall, said carrier further comprising a handle formed in each of said first and second dividing walls, each said package restraining flap being formed from lines of weakness in said dividing walls, permitting said restraining flap to be partially separated from said dividing walls, and each said restraining flap further comprising a fold line hinging the restraining flap to the respective dividing wall.

2. The carrier of claim 1 further comprising a handle formed in each of said first and second dividing walls.

3. The carrier according to claim 1 wherein said first and second package receiving areas are free to move relative to each other except at said hinge.

4. The carrier of claim 1 wherein said carrier includes a central vertical axis and said restraining flaps are offset laterally equally in opposite directions from said central vertical axis.

5. The carrier of claim 1 fabricated from corrugated board.

6. The carrier according to claim 1 wherein said first and second base flaps each has a free edge on a side opposite said first and second dividing panels.

7. A blank for a package carrier comprising:

a) a first dividing panel, b) a second dividing panel separated from said first dividing panel by a fold line, c) a first base section flap separated from said first dividing panel by a fold line on a side opposite said second dividing panel, said first base section including a free edge on a side opposite said first dividing panel, d) a second base section flap separated from said second dividing panel by a fold line on a side opposite said first dividing panel, said second base section including a free edge on a side opposite said second dividing panel, e) a first package restraining flap defined by lines of weakness and a fold line in said first dividing panel, f) a second package restraining flap defined by lines of weakness and a fold line in said second dividing panel, g) a first side panel on a side of said first dividing panel adjacent said fold line separating said first and second dividing panels and separated from said first dividing panel by a fold line, and h) a second side panel on a side of said second dividing panel adjacent said fold line separating said first and second dividing panels and separated from said second dividing panel by a fold line, each of said side panels including a flap separated therefrom by a fold line on a side opposite said fold line separating said first and second dividing panels.

8. The blank of claim 7 further comprising a third side panel on a side of said first dividing panel adjacent said fold line separating said first and second dividing panels and separated from said first dividing panel by a fold line and opposing said first side panel and a fourth side panel on a side of said second dividing panel adjacent said fold line separating said first and second dividing panels and separated from said second dividing panel by a fold line and opposing said second side panel.

9. The blank according to claim 7 comprising a handle formed in each of said first and second dividing panels.

10. The blank according to claim 7 wherein each said package restraining flap comprises an aperture suitable for receiving a bottle neck.

11. A carrier for multiple packages comprising a) a first dividing wall having a top and a bottom, b) a second dividing wall having a top and a bottom, c) said first and second dividing walls being hinged to each other at a hinge at their tops, d) a first base flap separated from said first dividing wall by a fold line at said first dividing wall bottom, e) a second base flap separated from said second dividing wall by a fold line at said second dividing wall bottom, f) a first side panel separated from said first dividing wall by a fold line adjacent to said hinge, g) a second side panel separated from said second dividing wall by a fold line adjacent to said hinge, h) said first dividing wall, first side panel, and first base flap defining a first package receiving area, i) said second dividing wall, second side panel, and second base flap defining a second package receiving area, j) first and second package restraining flaps extending respectively from said first and second dividing walls into said first and second package receiving areas, each of said first and second side panels including flaps separated therefrom by a fold line adjacent said fold line separating said first or second side panel from said first or second dividing wall, said side panel flaps forming with said first or second base flap a bottom for said carrier, each of said first and second dividing walls further including an auxiliary side panel and each auxiliary side panel including an auxiliary side panel flap separated by an auxiliary side panel flap-separating fold line adjacent a fold line separating said auxiliary side panel from said first or second dividing wall, said carrier further comprising a handle formed in each of said first and second dividing walls, said package restraining flaps being formed from lines of weakness in said dividing walls, permitting said restraining flaps to be partially separated from said dividing walls and said restraining flaps further comprising a fold line hinging the restraining flaps to the respective dividing wall, each said base having a front edge opposite said dividing wall and each said base front edge being free of attachment to a further panel or flap.

* * * * *